US005573893A

United States Patent [19]

Fujimoto et al.

[11] Patent Number: 5,573,893

[45] Date of Patent: Nov. 12, 1996

[54] METHOD FOR PROCESSING A SILVER HALIDE COLOR PHOTOGRAPHIC MATERIAL

[75] Inventors: Hiroshi Fujimoto; Takatoshi Ishikawa; Kazuaki Yoshida, all of Minami-Ashigara, Japan

[73] Assignee: Fuji Photo Film Co., Ltd., Kanagawa, Japan

[21] Appl. No.: 295,155

[22] Filed: Aug. 24, 1994

Related U.S. Application Data

[63] Continuation of Ser. No. 797,990, Nov. 26, 1991, abandoned.

[30] Foreign Application Priority Data

Nov. 28, 1990 [JP] Japan ..... 2-326211

[51] Int. Cl.[6] ..... G03C 7/42

[52] U.S. Cl. ..... 430/393; 430/460; 430/486; 430/493

[58] Field of Search ..... 430/393, 460, 430/493, 486

[56] References Cited

U.S. PATENT DOCUMENTS

| | | | |
|---|---|---|---|
| 2,444,803 | 7/1948 | Bean | 430/486 |
| 4,636,460 | 1/1987 | Mecke et al. | 430/442 |
| 5,028,517 | 7/1991 | Kuse et al. | 430/434 |
| 5,053,322 | 10/1991 | Shiba et al. | 430/490 |
| 5,091,292 | 2/1992 | Fujimoto et al. | 430/493 |

FOREIGN PATENT DOCUMENTS

| | | | |
|---|---|---|---|
| 326030 | 8/1989 | European Pat. Off. | 430/490 |
| 3059654 | 3/1991 | Japan | 430/490 |

*Primary Examiner*—Hoa Van Le

*Attorney, Agent, or Firm*—Sughrue, Mion, Zinn, Macpeak & Seas

[57] ABSTRACT

There is disclosed a method for processing a silver halide color photographic material. The method comprises processing a silver halide color photographic material having a photographic layer, the degree of swelling of which is 1.2 to 3.0, by a color developer containing at least one compound represented by formula (I) in an amount of 0.01 to 10 g per liter of said color developer.

Formula (I)

wherein $R_1$, $R_2$, $R_3$, and $R_4$ each represent a hydrogen atom, or an alkyl group, an alkoxy group, or an alkenyl group, which may be substituted, n is an integer of 1 to 3, and M represents a hydrogen atom or a counter cation.

7 Claims, No Drawings

METHOD FOR PROCESSING A SILVER HALIDE COLOR PHOTOGRAPHIC MATERIAL

This is a continuation of application Ser. No. 07/797,990, filed Nov. 26, 1991, now abandoned.

FIELD OF THE INVENTION

The present invention relates to a method for processing a silver halide color photographic material, and more particularly to a method for processing a silver halide color photographic material in which, after being processed, the photographic material occurs less stain and is improved in sticking preventing property.

BACKGROUND OF THE INVENTION

With respect to silver halide color photographic materials (hereinafter referred to as color photographic materials), reduction of processing waste liquid is strongly desired in view of environmental conservation. In regard to this, in recent years, although it has been promoted to lessen the replenishing amount of processing solutions, when the replenishing amount of a processing solution is lessened, the detention time of the processing solution in the processing bath becomes longer, which makes the processing solution susceptible to air oxidation or the like. This results in various adverse influences on the photographic performance of the color photographic material. It has been found that, for example, the processed color photographic material becomes contaminated with oxidation products of the processing solution, thereby bringing about so-called stain, or the washing-out of the undesired processing composition becomes poor, thereby making sticking preventing property of the color photographic material liable to be deteriorated during storage. Particularly, in addition to processing with a color developer at a low replenishment rate, if the desilvering process is carried out with a low replenishment rate or if a regeneration process is involved, it has been found that the above influences on the photographic performance constitute a significant problem.

In connection with this, in view of an improvement in sticking preventing property of color photographic materials, JP-A ("JP-A" means unexamined published Japanese patent application) No. 280248/1988 discloses to limit the degree of swelling (usually being in a range from 2 to 5) of color photographic materials and the condition of water washing step. It has been found, however, that when the replenishing amount of a color developer is small (i.e., 100 ml or less), if the desilvering process is carried out with the replenishing amount decreased or if a regeneration process is involved, not only can satisfactory prevention of sticking not be effected, but also a problem of stain due to contamination after processing arises.

In the present invention, the term "stain" due to contamination is stain occurred by adhesion to or taking into the film of the color photographic material from the processing solution, including stain formed in the unexposed white background of the color photographic material as well as that formed throughout in the dye image part. Thus, stain lowers the whiteness and also contaminates the formed color, thereby deteriorating the color reproduction.

On the other hand, techniques wherein various polymers are added to color developers have long been known. For example, JP-B ("JP-B" means examined Japanese patent publication) Nos. 41676/1971 and 21250/1975 disclose techniques wherein celluloses are added, JP-B No. 20743/1972 discloses a technique wherein pyrrolidones are added, and JP-B No. 16179/1983 discloses a technique wherein polymers are added. These are intended mainly to prevent a developing agent from depositing and do not disclose the effect of the present invention, and even if the above compounds are simply added the prevention of stain and sticking cannot be attained satisfactorily.

Techniques wherein surface-active agents are added to a color developer are disclosed in JP-A Nos. 234161/1987 and 42155/1987. However, the surface-active agents disclosed in the former are not satisfactory to attain the object of the present invention, while the latter neither refer to solving the problem addressed by the present invention, nor the effect of the system of the latter is satisfactory to solve the problems. Further, although *Research Disclosure* No. 16986 discloses a technique wherein by adding a nonionic surface-active agent the washing-out of a sensitizing dye is facilitated, thereby reducing the residual color.

SUMMARY OF THE INVENTION

Therefore the object of the present invention is to provide a method for processing a silver halide color photographic material which, after being processed, has less stain due to contamination and improved sticking preventing property during the storage, even when the color photographic material is subjected to processing by a color developer of low replenishing amount.

Other and further objects, features and advantages of the invention will appear more evident from the following detailed description.

DETAILED DESCRIPTION OF THE INVENTION

The above object has been attained by the method described below. That is, the present invention provides:

(1) A method for processing a silver halide color photographic material, which comprises processing a silver halide color photographic material having a photographic layer, the degree of swelling of which is 1.2 to 3.0, by a color developer containing at least one compound represented by the following formula (I) in an amount of 0.01 to 10 g per liter of said color developer:

Formula (I)

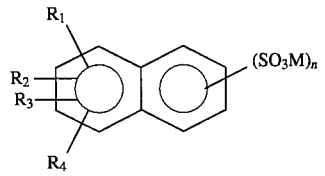

wherein $R_1$, $R_2$, $R_3$, and $R_4$ each represent a hydrogen atom, or an alkyl group, an alkoxy group, or an alkenyl group, which may be substituted, n is an integer of 1 to 3, and M represents a hydrogen atom or a counter cation.

(2) A method for processing silver halide color photographic material stated under (1) above, wherein, after the above color development processing, desilvering is effected and the concentration of carbonate ions in the desilvering solution that have been carried over from the color developer is $2.0\times10^{-1}$ mol/l to $3.0\times10^{-2}$ mol/l.

(3) A method for processing a silver halide color photographic material stated under (1) and/or (2) above, wherein said color developer is substantially free from benzyl alcohol.

The effect of the present invention is preferably attained by the mode stated under (2) or (3) above. As described above, sticking preventing property of color photographic materials or stain thereof after processing is apt to become a problem when the desilvering process is carried out with a low replenishment rate or when a regeneration process is involved, and thus it should be noted that, as is apparent from the constitution of the present invention, this appears to be related to the concentration of carbonate ions in the desilvering solution that have been carried over from the color developer.

The present invention now will be described in detail.

In formula (I), described above, $R_1$, $R_2$, $R_3$, and $R_4$, which may be the same or different, each represent a hydrogen atom or a substituted or unsubstituted alkyl, alkoxy, or alkenyl group. Preferably, at least one of $R_1$, $R_2$, $R_3$, and $R_4$ is an alkyl group, an alkoxy group, or an alkenyl group. Particularly preferably at least one of $R_1$, $R_2$, $R_3$, and $R_4$ is an alkyl group. The number of carbon atoms of the alkyl group, the alkoxy group, and the alkenyl group is 1 to 20, preferably 2 to 10. The substituent includes, for example, a hydroxyl group, a halogen atom, a cyano group, an amino group which may be substituted by alkyl, an alkoxy group having 1 to 4 carbon atoms, a sulfonic acid, a carboxylic acid, an acylamino group, a sulfonamido group, and a carbonylamido group, with an alkyl group having 1 to 4 carbon atoms being the most preferable. M represents a hydrogen atom or a counter cation and preferable examples thereof include an ammonium ion and an ion of alkali metals and alkali earth metals. n is an integer of 1 to 3 with 1 or 2 being particularly preferable.

Specific examples of the compound represented by formula (I) are given below, but the present invention is not restricted to them.

I-1

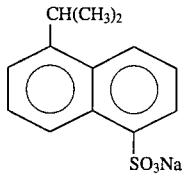

I-2

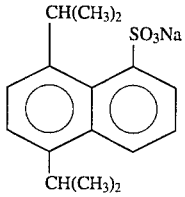

I-3

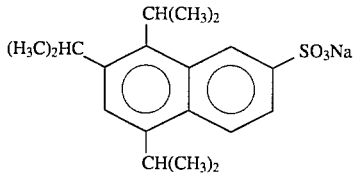

I-4

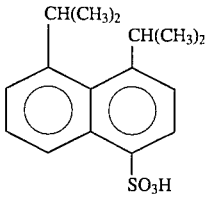

-continued

I-5

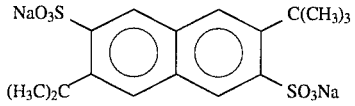

I-6

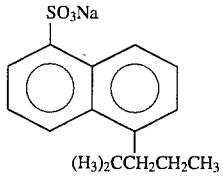

I-7

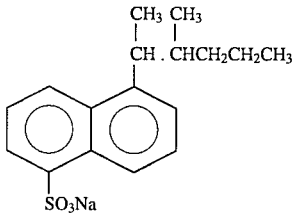

I-8

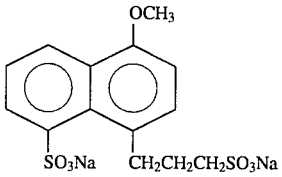

I-9

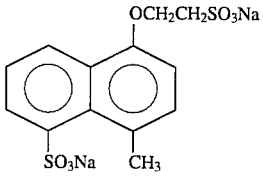

I-10

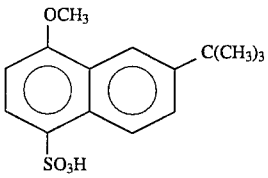

I-11

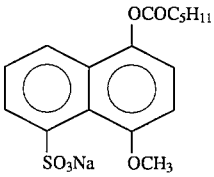

I-12

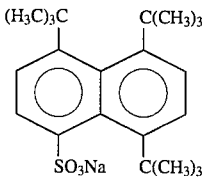

I-13

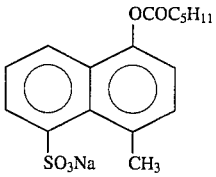

-continued

I-14

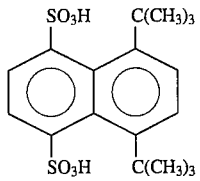

I-15

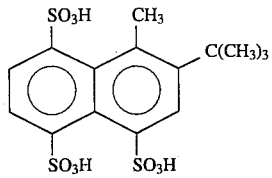

I-16

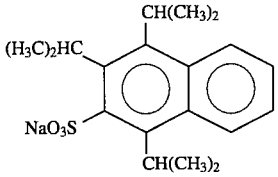

I-17

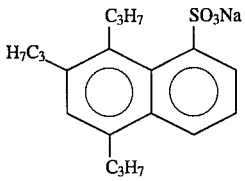

I-18

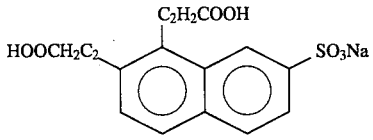

I-19

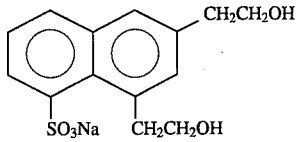

The compound represented by formula (I) in the present invention can be commercially available and also can be synthesized in accordance with the methods described in JP-B No. 8401/1969, U.S. Pat. Nos. 2,739,891, 3,502,473, and 3,026,202, JP-A Nos. 43924/1973, 79185/1971, and 46133/1975, British Patent No. 1,022,878, and U.S. Pat. Nos. 3,437,598 and 3,723,341.

The amount of the compound represented by formula (I) to be added in the present invention is 0.01 to 10 g, preferably 0.05 to 5 g, and particularly preferably 0.05 to 1 g, per liter of the color developer. It has been found that, when the amount of the compound is less than 0.01 g/l, the problem of stain that is liable to occur at the processing with a low replenishing amount of color developer can not been solved sufficiently, and, when the amount of the compound is more than 10 g/l, the color-forming property is affected to lower the maximum color density. The above compound may be allowed to dissolve out from the photographic material and may accumulate to reach the above concentration or the above compound may be added previously into the developing solution, the latter being preferable in order to maintain the effect.

In the present invention, it has been found that there is a relationship between stain due to contamination and the degree of swelling. Particularly this relationship becomes noticeable when the replenishing amount of the processing solution becomes small. In the present invention, the term "degree of swelling" means the value obtained by dividing the value of the thickness of the photographic layer obtained after immersing the color photographic material in distilled water at 33° C. for 2 min by the value of the thickness of the dry photographic layer. The degree of swelling in the present invention is 1.2 to 3.0, preferably 1.3 to 2.7.

If the degree of swelling is smaller than 1.2, the washing-out of undesired matter in the film becomes poor and stain after processing increases. On the other hand, if the degree of swelling is larger than 3.0, the sticking preventing property is deteriorated and the mechanical strength lowers, thereby resulting in such failures as the occurrence of abrasion flaws.

Herein the photographic layer comprises at least one photosensitive silver halide emulsion layer and a group of coated hydrophilic layers, which are water-permeable together with said photosensitive silver halide emulsion layer; excluded is the backing layer provided opposite to the photographic photosensitive layer and away from the base. The photographic layer generally is made up of multiple layers involved in the formation of a photographic image and it contains, in addition to silver halide emulsion layers, an intermediate layer, a filter layer, an antihalation layer, a protective layer, etc.

Any technique may be used for adjusting the degree of swelling to fall within the range defined in the present invention, and for example the degree of swelling can be adjusted by changing the amount or the type of gelatin or hardener to be used in the photographic film, or by changing the drying conditions or the aging conditions after the application of the photographic layer. It is advantageous to use gelatin in the photographic layer, but hydrophilic colloids other than gelatin can also be used. For example use can be made of gelatin derivatives, graft polymers of gelatin with other polymers, proteins such as albumin and casein, cellulose derivatives such as hydroxyethyl cellulose, carboxymethylcellulose, and cellulose sulfate, sodium alginate, saccharide derivatives such as starch derivatives; and a wide variety of synthetic hydrophilic polymeric substances, for example homopolymers and copolymers, such as polyvinyl alcohol, polyvinyl alcohol partially acetal, poly-N-vinylpyrrolidone, polyacrylic acid, polymethacrylic acid, polyacrylamide, polyvinylimidazole, and polyvinylpyrazole.

As gelatin, lime-processed gelatin and acid-processed gelatin as well as gelatin hydrolysate and gelatin enzymolysate can be used. As the gelatin derivative, one obtained by reacting gelatin, for example, with an acid halide, an acid anhydride, an isocyanate, bromoacetic acid, an alkanesulfone, a vinylsulfonamide, a maleinimide compound, a polyalkylene oxide, or an epoxy compound can be used. Specific examples thereof are described, for example, in U.S. Pat. Nos. 2,614,928, 3,132,945, 3,186,846, and 3,312,553, British Patent Nos. 861,414, 1,033,189, and 1,005,784, and JP-B No. 26845/1967.

As the gelatin graft polymer described above, one obtained by grafting, onto gelatin, a homopolymer or a copolymer of vinyl monomers, such as acrylic acid, methacrylic acid, their esters and amides, acrylonitrile, and styrene can be used. Particularly a graft polymer ofgelatin and a polymer compatible to a certain extent with gelatin is preferable such as a graft polymer of gelatin and a polymer such as acrylic acid, methacrylic acid, acrylamide, methacrylamide, and hydroxyalkyl methacrylates. Examples thereof are described, for example, in U.S. Pat. Nos. 2,763,625, 2,831,767, and 2,956,884. Typical synthetic hydrophilic polymeric substances are described, for example, in West German Patent Application (OLS) No. 2,312,708, U.S. Pat. Nos. 3,620,751 and 3,879,205, and JP-B No. 7561/1968.

As the hardener, for example, a chromate (e.g., chromium alum and chromium acetate), an aldehyde (e.g., formaldehyde, glyoxal, and glutaraldehyde), an N-methylol compound (e.g., dimethylolurea and methyloldimethylhydantoin), a dioxane derivative (e.g., 2,3-dihydroxydioxane), an active vinyl compound (e.g., 1,3,5-triacryloyl-hexahydro-s-triazine, bis(vinylsulfonyl)methyl ether, and N,N'-methylenebis-[β-(vinylsulfonyl)propionamide]), an active halogen compound. (e.g., 2,4-dichloro-6-hydroxy-s-triazine), a mucohalogenic acid (e.g., mucochloric acid and mucophenoxychloric acid), an isooxazole, dialdehyde starch, and 2-chloro-6-hydroxytriazinylated gelatin can be used alone or in combination. Specific examples thereof are described, for example, in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, and 3,543,292, British Patent Nos. 676,628, 825,544, and 1,270,578, German Patent Nos. 872,153 and 1,090,427, and JP-B No. 7133/1959 and 1872/1971.

Particularly preferable hardeners are aldehydes, active vinyl compounds, and active halogen compounds.

In the present invention the term "desilvering" refers to bleaching, bleach-fixing, or fixing after a color developing. Particularly when bleaching or bleach-fixing is carried out with a low replenishment amount or when a regeneration process is involved, carbonate ions carried over from a color developer increase in concentration, which is apt to lead to a problem of sticking or stain due to contamination. Therefore, the effect of the present invention is more exhibited when the concentration of carbonate ions in the desilvering bath is $2.0\times10^{-1}$ mol/l to $3.0\times10^{-2}$ mol/l, particularly preferably $2.5\times10^{-1}$ mol/l to $2.5\times10^{-2}$ mol/l.

Preferable processing with a low replenishing amount of a color developer in the present invention refers to processing with a replenishing amount of 150 ml or less, preferably 25 to 150 ml, more preferably 25 to 100 ml, particularly preferably 40 to 80 ml, per square meter of the color photographic material. If the replenishing amount is 150 ml or more, it cannot be said that the replenishing amount is low enough in view of the reduction of waste liquor demanded in recent years and the effect of the present invention cannot be clearly exhibited. On the other hand, if the replenishing amount is less than 25 ml per square meter of the color photographic material, in some cases the color developer condenses and decreases in volume, thereby making processing impossible or a satisfactory effect cannot be obtained even when the present constitution is followed, and therefore the replenishing amount is preferably 25 ml or more per square meter of the color photographic material.

The color developer of the present invention will now be described in more detail.

As a color-developing agent, an aminophenol compound is effective, but a p-phenylene diamine compound is preferably used. Typical examples thereof are given below, but the present invention is not restricted to them.

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxyethyl)amino]aniline

D-5: 2-methyl-4-[N-ethyl-N-(β-hydroxyethyl)amino] aniline

D-6: 4-amino-3-methyl-N-ethyl-N-[β-(methanesulfonamido)ethyl]-aniline

D-7: N-(2-amino-5-diethylaminophenylethyl) methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B No. 30496/1973.

As the other preservative, various metals described, for example, in JP-A Nos. 44148/1982 and 53749/1982, salicylic acids described, for example, in JP-A No.180588/1984, alkanolamines described, for example, JP-A No. 3532/1979, polyethyleneimines described, for example, in JP-A No. 94349/1981, and aromatic polyhydroxyl compounds described, for example, in U.S. Pat. No. 3,746,544 may be included, if needed. It is particularly preferable the addition of alkanolamines such astriethanolamine, dialkylhydroxylamines such as diethylhydroxkamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in JP-A Nos. 255270/1987, 9713/1988, 97114/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in JP-A Nos. 9713/1988 and 11300/1988.

Hydroxylamine derivatives represented by the following formula (III) are most preferable.

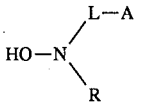

Formula (III)

wherein L represents a straight chain or branched chain alkylene group, which may be substituted, having 1 to 10 carbon atoms, preferably 1 to 5 carbon atoms. Specifically, a methylene group, a ethylene group, a trimethylene group, and propylene group are mentioned as preferable example. Substituents that can be mentioned represent a carboxyl group, a sulfo group, a phosphono group, a phosphinic acid residue, a hydroxyl group, or an ammonio group which may be alkyl substituted, and a carboxyl group, a sulfo group, a phosphono group, and hydoxyl group are preferable. A represents a carboxyl group, a sulfo group, a phosphono group, a phosphinic acid residue, hydroxyl group, an amino group which may be alkyl-substituted, an ammonio group which may be alkyl-substituted, a carbamoyl group which may be alkyl-substituted, or a sulfamoyl group which may be alkyl-substituted, and as preferable group can be mentioned a carboxyl group, a sulfo group, a hydroxyl group, a phosphono group, and a carbamoyl group which may be alkyl-substituted. As examples of —L—A that can be mentioned include a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group, and as particularly preferable can be mentioned a carboxymethyl group, a carboxyethyl group, a sulfoethyl group, a sulfopropyl group, a sulfonomethyl group, and phosphonoethyl group. R represents a hydrogen atom or a straight chain or branched chain alkyl group, which may be substituted, having 1 to 10 carbon atoms, preferably 1 to 5 carbon atoms. Substituents that can be mentioned represent a carboxyl group, a sulfo group, a phosphono group, a phosphinic acid residue, a hydroxyl group, an ammonio group which may be alkyl substituted, a ammonio group which may be alkyl substituted, a carbamoyl group which may be alkyl substituted or a sulfamoyl group which may be alkyl substituted. As preferable examples of R that can be mentioned include a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group, wherein a hydrogen atom, a carboxymethyl group, a carboxyethyl group, a sulfoethyl group, a sulfopropyl group, a phosphonomethyl group, and a phosphonoethyl group are can be mentioned as particularly preferable example. L and R can be bonded together to form a ring.

Specified compounds of this invention are shown below, but the invention is not limited by them.

Formula (III)

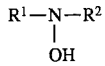

| Compound No. | $R^1$ | $R^2$ |
|---|---|---|
| (1) | $-C_2H_5$ | $-C_2H_5$ |
| (2) | $-CH_3$ | $-C_2H_4OCH_3$ |
| (3) | $-C_2H_4OCH_3$ | $-C_2H_4OCH_3$ |
| (4) | $-CH_2OCH_3$ | $-CH_2OCH_3$ |
| (5) | $-CH_2CO_2H$ | $-CH_2CO_2H$ |
| (6) | $-C_2H_4CO_2H$ | $-C_2H_4CO_2H$ |
| (7) | $-CH(C_2H_5)CO_2H$ | $-CH(C_2H_5)CO_2H$ |
| (8) | $-C_2H_4SO_3Na$ | $-C_2H_4SO_3Na$ |
| (9) | $-(CH_2)_3SO_3H$ | $-(CH_2)_3SO_3H$ |
| (10) | $-(CH_2)_4SO_3K$ | $-(CH_2)_4SO_3K$ |
| (11) | $-CH_2PO_3H_2$ | $-CH_2PO_3H_2$ |
| (12) | $-C_2H_4OH$ | $-C_2H_4OH$ |
| (13) | $-C_2H_4\overset{\oplus}{N}(CH_3)_3$ | $-C_2H_9\overset{\oplus}{N}(CH_3)_3.SO_4^{2\ominus}$ |
| (14) | $-CH(C_2H_5)CO_2H$ | $-H$ |
| (15) | $-C_2H_4SO_3Na$ | $-H$ |
| (16) | $-CH_2CH(OH)CH_2SO_3H$ | $-H$ |
| (17) | $-(CH_2)_3SO_3H$ | $-H$ |
| (18) | $-CH_2PO_3H_2$ | $-H$ |
| (19) | $-C_2H_4OH$ | $-H$ |
| (20) | $-C_2H_4\overset{\oplus}{N}(CH_3)_3$ | 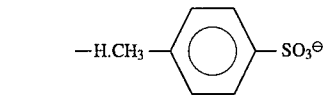 |
| (21) | $-C_2H_4SO_3H$ | $-CH_3$ |
| (22) | $-C_2H_4CO_2H$ | $-CH_3$ |
| (23) | $-C_2H_4SO_3H$ | $-CH_2CO_2H$ |
| (24) | $-C_2H_4SO_3\ominus$ | $-C_2H_4N\oplus(CH_3)_3$ |
| (25) | $-C_2H_4N(CH_3)_2$ | $-C_2H_4CO_2H$ |
| (26) | 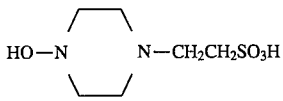 | |

-continued

Formula (III)

$$R^1-\underset{\underset{OH}{|}}{N}-R^2$$

| Compound No. | $R^1$ | $R^2$ |
|---|---|---|
| (27) | 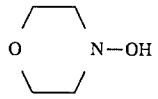 | |
| (28) | 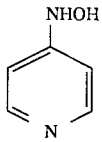 | |

Compound represented by formula (III) of the present invention is preferably added so as to be concentration of $5\times10^3$ to $5\times10$ mol, preferably $1\times10^2$ to $1\times10$ mol, per liter of color developer. Further these compounds may be form an alkali metal salt or a salt with various organic or inorganic acids, such as sulfuric acid, hydrochloric acid, nitric acid, and oxalic acid.

In the present invention, it is preferable that the color developer contains chloride ions in an amount of $3.5\times10^{-2}$ to $1.5\times10^{-1}$ mol/l, particularly preferably $4\times10^{-2}$ to $1\times10^{-1}$ mol/l. If the concentration of chloride ions is too large, it is not preferable that the development is made disadvantageously slow, not leading to attainment of the objects of the present invention such as rapid processing and high density. On the other hand, if the concentration of chloride ions is too small, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l. If the concentration of bromide ions is too large, the development is made slow, the maximum density and the sensitivity are made low, and if the concentration of bromide ions is too small, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. In the present invention, carbonate salts are particularly preferable.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1- hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a fluorescent whitening agent. As a fluorescent whitening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min.

As the bleaching agent that can be used in a bleaching solution or a bleach-fixing solution, use is made of any bleaching agents, but particularly it is preferable to use organic complex salts of iron (III) (e.g., complex salts of aminopolycarboxylic acids, such as ethylenediaminetetraacetic acid and diethylenetriaminepentaacetic acid, aminopolyphosphonic acids, phosphonocarboxylic acids, and organic phosphonic acids); organic acids, such as citric acid, tartaric acid, and maleic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fixing solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The smaller the replenishing amount of the bleach-fix solution or bleaching solution at the time of continuous processing is, with respect to environmental conservation and cost, the better it is. For the effect of the present invention, a more desirable effect can be obtained when the replenishing amount is 1 to 10 times, preferably 2 to 7 times, and more preferably 2 to 5 times, the amount of the color developer that has been carried over. This seems to be related to the carry-over of carbonate ions in the color developer, and in the present invention preferably the concentration of carbonate ions in the bleach-fixing solution or bleaching solution is $2.0\times10^{-1}$ mol/l to $3.0\times10^{-2}$ mol/l, more preferably $2.0\times10^{-1}$ mol/l to $4\times10^{-2}$ mol/l.

The case wherein, instead of the above processing with a low replenishing amount, regeneration processing of the bleach-fixing solution and bleaching solution is carried out is also a preferable mode in view of the effect of the present invention. As the most preferable regeneration processing, the case wherein a powder of a regenerating agent containing, for example, ammonium thiocyanate and sodium sulfite is added to the overflow of the bleach-fixing solution or the bleaching solution, and the resulting solution is reused as a replenishing solution of the bleach-fixing solution or the bleaching solution to effect regeneration substantially at a regeneration rate of 95% or more, is particularly effective. Herein the term "regeneration rate" means the rate of the reuse to the overall overflow.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and other bactericides can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

The preferable replenishing amount per unit area of photographic material is 0.5 to 50 times, more preferably 3 to 40 times amount of solution carried over from the preceding bath. In other words, it is 1 liter or below, preferably 500 ml or below, per square meter of photographic material. The replenishing may be carried out continuously or intermittently.

Solutions which used in washing process and/or stabilizing process can be used further in preceding process. Of this example it can be mentioned that the overflow of washing water which reduced by multi-stage counter current system is introduced to the preceding bleach-fixing bath and a concentrated solution is replenished into the bleach-fixing bath to reduce the waste solution.

As a silver halide to be used in the present invention, for example, silver chloride, silver bromide, silver bromo(iodo)chloride, and silver bromoiodide can be used, although preferably use is made of a silver chloride emulsion or silver bromochloride emulsion substantially free from silver iodide and having a silver chloride content of 90 mol % or more, more preferably 95 mol % or more, and particularly preferably 98% or more, for the purpose of rapid processing.

In the photographic material of the present invention, in order to improve, for example, the sharpness of an image, preferably a dye that can be processed to be decolored (in particular an oxonol dye), as described in European Patent EP 0,337,490A2, pages 27 to 76 is added to the hydrophilic colloid layer, or titanium oxide, whose surface has been treated with a dihydric to tetrahydric alcohol (e.g., trimethylolethane), is contained in an amount of 12% by weight or more (more preferably 14% by weight or more) in the water-resistant resin layer of the base.

In the photographic material of the present invention, a compound to improve the lasting quality of the image dye, as described in European Patent EP 0,277,589A2, is preferably used in combination with the coupler.

Combination with a pyrazoloazole coupler is particularly preferable.

That is, the use of a compound (F), which will chemically combine with the aromatic primary amine developing agent remaining after color development processing to produce a chemically inactive and substantially colorless compound, and/or a compound (G), which will chemically combine with the oxidized product of the aromatic primary amine developing agent remaining after color development processing to produce a chemically inactive and substantially colorless compound, is preferable because, for example, the occurrence of stain due to the production of a color formed dye by the reaction between the coupler and the color-developing agent remaining in the film or its oxidized product and other side effects related to storage after the processing can be prevented.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII): Formula (FI)

$$R_{21}-(A_1)_n-X_{21}$$

$$R_{22}-\underset{\underset{B_1}{|}}{C}=Y_1 \qquad \text{Formula (FII)}$$

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, $X_{21}$ represents a group that will react with the aromatic amine developing agent and split off, $B_1$ represents a hydrogen atom, an aliphatic group, an aromatic group, a heterocyclic group, an acyl group, or a sulfonyl group, $Y_1$ represents a group that will facilitate the addition of the aromatic amine developing agent to the compound represented by formula (FII), and $R_{21}$ and $X_{21}$, or $Y_1$ and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, European Published Patent Nos. 298,321 and 277,589.

On the other hand, more preferable examples of compound (G), which will chemically bond to the oxidized product of the aromatic amine developing agent remaining after color development processing, to form a chemically inactive and colorless compound, can be represented by the following formula (GI):

Formula (GI)

$$R_{23}-Z$$

wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein "$CH_3I$ value (R. G. Pearson, et al., *J. Am. Cem. Soc.*, 90, 319 (1968)) is 5 or over, or a group derived therefrom.

Specific examples of compounds reprsented by formula (GI) are described, for example, in European Published Patent No. 255722, JP-A Nos. 143048/1987 and 229145/1987, Japanese Patent Application Nos. 136724/1988 and 214681/1987, and European Published Patent Nos. 298321 and 277589.

Details of combinations of compound (G) and compound (F) are described in European Published Patent No. 277589.

To the photographic material according to the present invention, a mildewproofing agent, as described in JP-A No. 271247/1988, is preferably added in order to prevent the growth of a variety of mildews and fungi that will propagate in the hydrophilic colloid layer and deteriorate the image.

The photographic material of the present invention may be exposed to visible light or infrared light. The method of exposure to light may be low-intensity exposure or high-intensity short-time exposure, and particularly in the latter case, a laser scan exposure system wherein the exposure time per picture element is less than $10^{-4}$ sec is preferable.

When exposure is carried out, the band stop filter described in U.S. Pat. No. 4,880,726 is preferably used. Thereby, light color mixing is eliminated and the color reproduction is remarkably improved.

As a base to be used for the photographic material of the present invention, a white polyester base for display may be used, or a base may be used wherein a containing a white pigment is placed on the side that will layer have the silver halide emulsion layer. Further, in order t improve sharpness, preferably an anti-halation layer is applied on the side of the base where the silver halide emulsion layer is applied or on the under surface of the base. In particular, preferably the transmission density of the base is set in the range of 0.35 to 0.8, so that the display can be appreciated through either reflected light of transmitted light.

The exposed photographic material may be subjected to conventional black-and-white development processing or color processing and, in the case of a color photographic material, preferably it is subjected to color development processing and then is bleached and fixed for the purpose of rapid processing. In particular, when the above-mentioned high-silver-chloride emulsion is used, the pH of the bleach-fix solution is preferably about 6.5 or below, more preferably about 6 or below, for the purpose of accelerating desilvering, etc.

With respect to silver halide emulsions, other materials (e.g., additives), and photographic component layers (e.g., layer arrangement) that will be applied to the photographic material of the present invention as well as processing methods and processing additives which will be applied to the photographic material of the present invention, particularly those described in below-mentioned patent publications, particularly in European Patent EP 0,355,660A2 (JP-A No. 107011/1989), are preferably used.

| Element constituting photographic material | JP-A No. 215272/1987 | JP-A No. 33144/1990 | EP 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p.45 line 53 to p.47 line 3 and p.47 lines 20 to 22 |

-continued

| Element constituting photographic material | JP-A No. 215272/1987 | JP-A No. 33144/1990 | EP 0,355,660A2 |
|---|---|---|---|
| Solvent for silver halide | p.12 lower left column line 6 to 14 and p.13 upper left column line 3 from the bottom to p.18 lower left column last line | — | — |
| Chemical sensitizing agent | p.12 lower left column line 3 from the bottom to lower right column line 5 from the bottom and p.18 lower right column line 1 to p.22 upper right column line 9 from the bottom | p.29 lower right column line 12 to last line | p.47 lines 4 to 9 |
| Spectral sensitizing agent (method) | p.22 upper right column line 8 from the bottom to p.38 last line | p.30 upper left column lines 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |
| Color coupler (Cyan, Magent, and Yellow coupler) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color Formation-strengthen agent | p.121 upper left column line 7 to p.125 upper right column line 1 | — | — |
| Ultra violet absorbent | p.125 upper right column line 2 to p.127 lower left column last line | p.37 lower right column line 14 to p.38 upper left column line 11 | p.65 lines 22 to 31 |
| Discoloration inhibitor (Image-dye stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling and/or low-boiling solvent | p.137 lower left column line 9 to p.144 upper right column last line | p.35 lower right column line 14 to p.36 upper left column line 4 | p.64 lines 1 to 51 |
| Method for dispersing additives for photograph | p.144 lower left column line 1 to p.146 upper right column line 7 | p.27 lower right column line 10 to p.28 upper left column last line and p.35 lower right column line 12 to p.36 upper right column line 7 | p.63 line 51 to p.64 line 56 |
| Film Hardener | p.146 upper right column line 8 to p.155 lower left column line 4 | — | — |
| Developing Agent precursor | p.155 lower left column line 5 to p.155 lower right column line 2 | — | — |
| Compound releasing development restrainer | p.155 lower right column lines 3 to 9 | — | — |
| Base | p.155 lower right column line 19 to p.156 upper left column line 14 | p.38 upper right column line 18 to p.39 upper left column line 3 | p.66 line 29 to p.67 line 13 |
| Constitution of photosensitive layer | p.156 upper left column line 15 to p.156 lower right column line 14 | p.28 upper right column lines 1 to 15 | p.45 lines 41 to 52 |
| Dye | p.156 lower right column line 15 to p.184 lower right column last line | p.38 upper left column line 12 to upper right column line 7 | p.66 lines 18 to 22 |
| Color-mix inhibitor | p.185 upper left column line 1 to p.188 lower right column line 3 | p.36 upper right column lines 8 to 11 | p.64 line 57 to p.65 line 1 |
| Gradation controller | p.188 lower right column lines 4 to 8 | — | — |
| Stain | p.188 lower right column | p.37 upper left column last | p.65 line 32 |

-continued

| Element constituting photographic material | JP-A No. 215272/1987 | JP-A No. 33144/1990 | EP 0,355,660A2 |
|---|---|---|---|
| inhibitor | line 9 to p.193 lower right column line 10 | line to lower right column line 13 | to p.66 line 1 |
| Surface-active agent | p.201 lower left column line 1 to p.210 upper right column last line | p.18 upper right column line 1 to p.24 lower right column last line and p.27 lower left column line 10 from the bottom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder (Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line 3 to p.230 upper left column line 1 | — | — |
| Polymer latex latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of JP-A No. 21572/1987, amendment filed on March 16, 1987 is included.

Further, as cyan couplers, diphenylimidazole cyan couplers described in JP-A No. 33144/1990, as well as 3-hydroxypyridine cyan couplers described in European Patent EP 0,333,185A2 (in particular one obtained by causing Coupler (42), which is a four-equivalent coupler, to have a chlorine coupling split-off group, thereby rendering it two-equivalent, and Couplers (6) and (9), which are listed as specific examples, are preferable) and cyclic active methylene cyan couplers described in JP-A No. 32260/1989 (in particular, specifically listed Coupler Examples 3, 8, and 34 are preferable) are preferably used.

According to the process of this invention, contamination after processing is less and sticking preventing property during storage is improved. This effect is more conspicuous particularly when the concentration of carbonate ions in a bleaching solution or a bleach-fixing solution is $2.0\times10^{-1}$ to $3\times10^{-2}$ mol/l.

That effect is particularly remarkable when benzyl alcohol, which is generally used in a color developer (particularly a color developer used for photographic materials for color prints), is removed.

Next, the present invention will be described in detail in accordance with examples, but the invention is not limited to these examples.

EXAMPLE 1

A multilayer color photographic paper was prepared by coating layers as hereinbelow described on a paper laminated on both sides with polyethylene and subjected to surface corona discharge treatment. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved.. The resulting solution was added to 450 ml of 10% aqueous gelatin solution containing sodium dodecylbenzenesulfonate and Alkanol B (manufactured by du Pont Co.), and then the mixture was dispersed by a supersonic homogenizer. The resulting dispersion was mixed with and dissolved in 420 g of silver chloro-bromide emulsion (silver bromide: 0.7 mol %) containing a blue-sensitive sensitizing dye, described below, to prepare the first-layer coasting solution.

Coating solutions for the second to seventh layers were also prepared in the same manner as in the first layer coating solution. As a gelatin hardener for the respective layers, a mixture (1:1 in molar ratio) of 1,2-bis(vinylsulfonyl)ethane and sodium 2,4-dichloro-6-hydroxy-s-triazine was used. At that time, the amount of hardener to be added was adjusted so as to the degree of swelling being as shown in Table 1.

As spectral sensitizers for the respective layers, the following compounds were used:

Blue-sensitive emulsion layer:

Anhydro-5,5'-dichloro-3,3'-disulfoethylthiacyanine hydroxide

Green-sensitive emulsion layer:

Anhydro-9-ethyl-5,5'-diphenyl-3,3'-disulfoethyloxacarbocyanine hydroxide

Red-sensitive emulsion layer:

3,3'-Diethyl-5-methoxy-9,11-neopentylthiadicarbocyanine iodide

As a stabilizer for the respective emulsion layer, a mixture (6:2:2 in molar ratio) of the following compounds was used:

1-(2-Acetoaminophenyl)-5-mercaptotetrazole,

2-Methylthio-5-mercapto-1,3,4-thiadiazole, and 1-(p-Carboxyphenyl)-2-acetylamino-5-mercapto-1,3,4-triazole As irradiation preventing dyes the following compounds were used:

[3-Carboxy-5-hydroxy-4-(3-(3-carboxy-5-oxo-1-(2,5-disulfonatophenyl)-2-pyrazoline-4-iridene)-1-propenyl)-1-pyrazolyl]benzene-2,5-disulfonate-disodium salt, N,N'-(4,8-Dihydroxy-9,10-dioxo-3,7-disulfonatoanthracene-1,5-diyl)bis(aminomethanesulfonate) tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonate-sodium salt (Composition of layers)

The composition of each layer is shown below. The figures represent coating amounts (g/m$^2$). The coating amounts of each silver halide emulsion is represented in terms of silver.

| First Layer (Blue-sensitive emulsion layer) | |
|---|---|
| Gelatin | 1.8 |
| The above-described silver chlorobromide emulsion (silver bromide: 0.7 mol %) | 0.4 |
| Yellow coupler (ExY) | 0.67 |
| Discoloration inhibitor (Cpd-1) | 0.1 |
| Color-mix inhibitor (Cpd-2) | 0.3 |
| Solvent (Solv-1) | 0.09 |
| Solvent (Solv-2) | 0.045 |
| **Second Layer (Color-mix preventing layer)** | |
| Gelatin | 0.8 |
| Color-mix inhibitor (Cpd-2) | 0.05 |
| Solvent (Solv-1) | 0.03 |
| Solvent (Solv-2) | 0.015 |
| **Third Layer (Green-sensitive emulsion layer)** | |
| Gelatin | 1.9 |
| Silver chlorobromide emulsion (silver bromide: 1.5 mol %) | 0.32 |
| Magenta coupler (ExM) | 0.25 |
| Discoloration inhibitor (Cpd-3) | 0.17 |
| Discoloration inhibitor (Cpd-4) | 0.10 |
| Solvent (Solv-1) | 0.27 |
| Solvent (Solv-2) | 0.03 |
| **Fourth Layer (Color-mix preventing layer)** | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| **Fifth Layer (Red-sensitive emulsion layer)** | |
| The above-described silver chlorobromide emulsion (AgBr: 4 mol %, cubic grain, average grain size: 0.59 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| **Sixth layer (Ultraviolet ray absorbing layer)** | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| **Seventh layer (Protective layer)** | |
| Gelatin | 1.1 |

Compound used are as follows:

(ExY) Yellow coupler

-continued

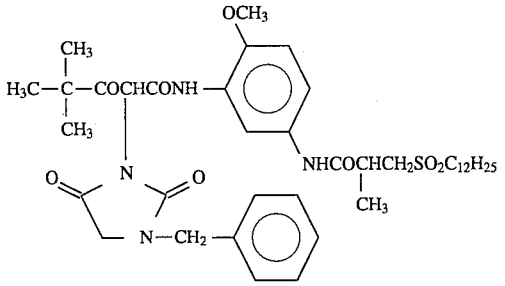

(ExM) Magenta coupler

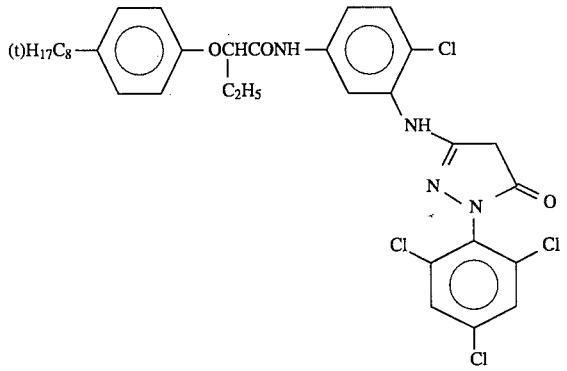

(ExC-1) Cyan coupler

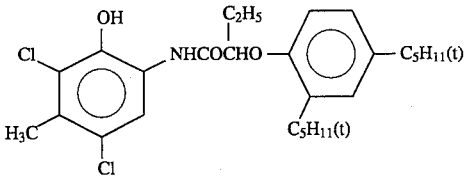

(ExC-2) Cyan coupler

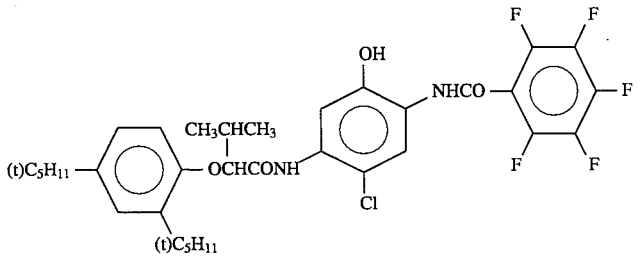

(Cpd-1) Discoloration inhibitor

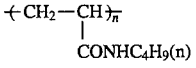

Average molecular weight: 80,000

(Cpd-2) Color-mix inhibitor 2,5-Di-tert-octylhydroquinone (Cpd-3) Discoloration inhibitor 7,7'-dihydroxy-4,4,4',4'-tetramethyl-2,2-spirocumarone (Cpd-4) Discoloration inhibitor N-(4-dodecyloxyphenyl)morpholine (Cpd-5) Color-forming accelerator p-(p-Toluenesulfonamido)phenyldodecane (Solv-1) Solvent Di(2-ethylhexyl)phthalate (Solv-2) Solvent Dibutylphthalate (Solv-3) Solvent Di(i-nonyl)phthalate (Solv-4) Solvent N,N-diethylcarbonamido-methoxy-2,4-di-t-amylbenzene (UV-1) Ultraviolet absorber 2-(2-Hydroxy-3,5-di-tert-amylphenyl)benzotriazole (UV-2) Ultraviolet absorber 2-(2-Hydroxy-3,5-di-tert-butylphenyl)benzotriazole Sample thus-obtained by coating was subjected to a gradation exposure to light for sensitometry using a sensitometer (FWH model by Fuji Photo Film Co., Ltd., the color temperature of light source was 3200° K.). At that time, the exposure was carried out in such a manner that the exposure was 250 CMS with the exposure time being 0.1 second.

The sample exposed to light was processed by the processing process shown below.

| Processing steps | Temperature | Time |
|---|---|---|
| Color developing | 38° C. | 45 sec |
| Bleach-fixing | 35° C. | 45 sec |
| Stabilizing (1) | 35° C. | 20 sec |
| Stabilizing (2) | 35° C. | 20 sec |
| Stabilizing (3) | 35° C. | 20 sec |
| Drying | 80° C. | 60 sec |

The compositions of the respective processing solution were as follows:

| Color developer | |
|---|---|
| Water | 700 ml |
| Additive (see Table 1) | 0.1 g |
| Benzyl alcohol | (See Table 1) |
| Diethylene glycol | (See Table 1) |
| Diethylenetetraminepentaacetic acid | 3.0 g |
| Triethylenetetraminehexaacetic acid | 1.5 g |
| Triethanolamine | 12.0 g |
| Potassium chloride | 6.5 g |
| Potassium bromide | 0.02 g |
| Potassium carbonate | 27.0 g |
| Fluorescent brightening agent (WHITEX 4B, made by Sumitomo Chem. Ind.) | 1.0 g |
| Sodium sulfite | 0.1 g |
| No. 4 Compound of formula (III) | 10.0 g |
| N-ethyl-N-(β-methanesulfonamidoethyl)-3-methyl-4-aminoaniline sulfate | 5.0 g |
| Water to make | 1000 ml |
| pH (25° C.) | 10.10 |
| **Bleach-fixing solution** | |
| Water | 600 ml |
| Ammonium thiosulfate (700 g/l) | 100 ml |
| Ammonium sulfite | 40 g |
| Iron (III) ammonium ethylenediaminetetraacetate | 55 g |
| Ethylenediaminetetraacetic acid | 5 g |
| Ammonium bromide | 40 g |
| Nitric acid (67%) | 30 g |
| $K_2CO_3$ | (See Table 1) |
| Water to make | 1000 ml |
| pH (25° C.) (adjusted by acetic acid and aqueous ammonia) | 5.8 |
| **Stabilizing solution** | |
| Formalin (37%) | 0.1 g |
| Formalin-sulfurous acid adduct | 0.7 g |
| 5-Chloro-2-methyl-4-isothiazoline-3-one | 0.02 g |
| 2-Methyl-4-isothiazoline-3-one | 0.01 g |
| Copper sulfate | 0.005 g |
| Aqueous ammonia (28%) | 2.0 g |
| Water to make | 1000 ml |
| pH (25° C.) | 4.0 |

After the color photographic materials wherein the amounts of hardeners were adjusted were processed under conditions shown in Table 1, the minimum density (Dmin) of the yellow was measured. Further, each of the color developers was placed in a 1-liter beaker and was aged for 7 days at 40° C. After the aging, the color photographic materials were processed similarly and the minimum density (Dmin) of the yellow color was measured to find the increment (ΔDmin). The maximum density part (Dmax) of each of the color photographic materials processed after the above aging was cut into two pieces measuring 4 cm×4 cm each, the pieces were put together with the emulsion surfaces faced each other, a load weighing 500 g was placed on top of them, they were allowed to stand for 3 days at 35° C./80% RH, and then they were separated and the extent of sticking between the emulsion surfaces was evaluated according to the following four step criteria:

○: there was no sticking mark.

Δ: there was no sticking mark but there were crazes in the surface.

X: there were sticking marks.

XX: Due to the stickings, there was separation of the emulsion surface.

The results are shown in Table 1.

TABLE 1

| No. | Degree of swelling | Additive in color developer | Benzyl alcohol/ Diethylene glycol (ml/l) | $K_2CO_3$ in bleach-fixing solution (mol/l) | Yellow Δ Dmin | Sticking preventing property | Remarks |
|---|---|---|---|---|---|---|---|
| 1 | 1.0 | — | — | — | 0.09 | Δ | Comparative example |
| 2 | " | I-1 | — | — | 0.08 | Δ | " |
| 3 | " | I-2 | — | — | 0.08 | Δ | " |
| 4 | " | I-3 | — | — | 0.08 | Δ | " |
| 5 | 1.3 | — | — | — | 0.07 | Δ | " |
| 6 | " | I-1 | — | — | 0.01 | ○ | This invention |
| 7 | " | I-2 | — | — | 0.01 | ○ | " |
| 8 | " | I-3 | — | — | 0.00 | ○ | " |
| 9 | 1.8 | — | — | — | 0.09 | x | Comparative example |
| 10 | " | I-3 | — | — | 0.01 | ○ | This invention |
| 11 | 2.2 | I-4 | — | — | 0.01 | ○ | " |
| 12 | " | I-6 | — | — | 0.01 | ○ | " |
| 13 | 3.2 | I-3 | — | — | 0.05 | x | Comparative example |
| 14 | " | I-7 | — | — | 0.05 | xx | " |
| 15 | 1.0 | — | 10/15 | — | 0.12 | x | " |
| 16 | " | — | — | $3.2 \times 10^{-2}$ | 0.10 | x | " |
| 17 | " | — | — | $1.0 \times 10^{-1}$ | 0.11 | x | " |
| 18 | " | I-3 | 10/15 | — | 0.10 | x | " |

TABLE 1-continued

| No. | Degree of swelling | Additive in color developer | Benzyl alcohol/ Diethylene glycol (ml/l) | $K_2CO_3$ in bleach-fixing solution (mol/l) | Yellow Δ Dmin | Sticking preventing property | Remarks |
|---|---|---|---|---|---|---|---|
| 19 | " | " | — | $3.2 \times 10^{-2}$ | 0.10 | x | " |
| 20 | " | " | — | $1.0 \times 10^{-1}$ | 0.10 | x | " |
| 21 | 1.8 | — | 10/15 | — | 0.12 | xx | Comparative example |
| 22 | " | — | — | $3.2 \times 10^{-2}$ | 0.12 | xx | " |
| 23 | " | — | — | $1.0 \times 10^{-1}$ | 0.11 | xx | " |
| 24 | " | I-3 | 10/15 | — | 0.03 | Δ | This invention |
| 25 | " | " | — | $3.2 \times 10^{-2}$ | 0.02 | ○ | " |
| 26 | " | " | — | $1.0 \times 10^{-1}$ | 0.01 | ○ | " |
| 27 | " | " | — | $2.2 \times 10^{-1}$ | 0.02 | ○ | " |
| 28 | 2.0 | I-8 | — | $3.1 \times 10^{-2}$ | 0.01 | ○ | " |
| 29 | " | I-9 | — | " | 0.01 | ○ | " |
| 30 | " | I-10 | — | " | 0.01 | ○ | " |
| 31 | 1.5 | I-4/II-1 | — | " | 0.00 | ○ | " |
| 32 | " | I-3/II-5 | — | " | 0.01 | ○ | " |
| 33 | " | I-13/II-8 | — | " | 0.00 | ○ | " |
| 34 | " | a | — | " | 0.08 | x | Comparative example |
| 35 | " | b | — | " | 0.09 | x | " |

Compounds used are as follows:

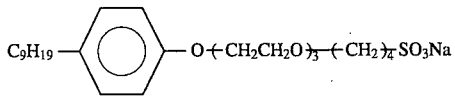

II-1

$C_{16}H_{33}O(CH_2CH_2O)_{20}H$ II-5

$C_{18}H_{37}O(CH_2CH_2O)_{10}(CH_2CH(OH)CH_2O)_5H$ II-8

Comparative compound

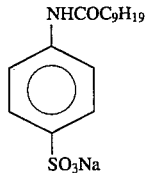

a.

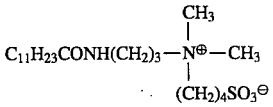

b.

It is shown in Table 1 that when the degree of swelling is as low as 1.0, the ΔDmin of the yellow color is large (Nos. 1, 2, 3, and 4) regardless of the presence or absence of the additive of the present invention.

It can also be understood that the presence of benzyl alcohol brings undesirable results in the ΔDmin of the yellow color and the sticking preventing property, and therefore the absence of benzyl alcohol is preferable.

Further, where the concentration of $K_2CO_3$ in the bleach-fixing solution falls within the preferable range of the present invention, a desirable effect is obtained when the degree of swelling of the color photographic material and the additive fall within the scope of the present invention, although the effect is lowered when the degree of swelling of the color photographic material and the additive fall outside the scope of the present invention. That is, even if a low replenishing amount or regeneration processing of a bleach-fixing solution is taken into consideration, according to the present constitution, a desirable effect can be obtained.

Next, Sample No. 10 that was prepared for the above test was cut into pieces (4 cm×4 cm), and each piece was subjected to the same development processing as described above, except that the kind and the amount of compound represented by formula (I) to be added in the color developer were changed as shown in Table 2. After processing, the maximum density (Dmax) of the magenta color and the minimum density (Dmin) of the yellow color were measured. Further, each of the color developer was aged in the same manner as described above. After the aging, each piece of Sample 10 was processed similarly and the Dmin of the yellow color was measured to determine the increment (ΔDmin).

Results are shown in Table 2.

TABLE 2

| Degree of swelling | Compound of formula (I) No. | Compound of formula (I) Amount added (g/l) | Yellow Δ Dmin | Magnenta Dmax | Remarks |
|---|---|---|---|---|---|
| 1.8 | I-3 | 0.1 | 0.01 | 2.70 | This invention |
| " | I-4 | " | 0.01 | 2.68 | This invention |
| " | I-6 | " | 0.01 | 2.70 | This invention |
| " | I-3 | 0.005 | 0.07 | 2.70 | Comparative example |
| " | I-4 | " | 0.09 | 2.69 | Comparative example |
| " | I-6 | " | 0.09 | 2.70 | Comparative example |
| " | I-3 | 11.0 | 0.01 | 2.1 | Comparative example |
| " | I-4 | " | 0.01 | 2.0 | Comparative example |
| " | I-6 | " | 0.01 | 1.9 | Comparative example |

As is apparent from the results in Table 2, when the amount of compound represented by formula (I) in the color developer is as low as outside the scope of this invention, increment of Dmin of the yellow color becomes large, and when the amount is as large as outside the scope of this invention, Dmax of the magenta color becomes small, each compared with the value obtained according to this invention.

EXAMPLE 2

A multilayer color print paper having the following layer composition was prepared by coating various photographic constituting layers on the surface of paper support. The paper support on which polyethylene film was laminated both side, followed by being subjected to a surface corona discharge treatment and then provided a prime coat containing sodium dodecylbenzenesulfonate was used. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and each 4.1 g of solvents (Solv-3) and (Solv-7) were added and dissolved. The resulting solution was dispersed and emulsified in 185 ml of 10% aqueous gelatin solution containing 8 ml of sodium dodecylbenzenesulfonate, to prepare emulsified dispersion A. Separately silver chlorobromide emulsion A (mixture (3:7 in silver molar ratio) of large size emulsion A comprising cubic grains having 0.88 μm of average grain size and small size emulsion A comprising cubic grains having 0.70 μm of average grain size, respective deviation coefficient of grain size distribution being 0.08 and 0.10, and each in which 0.3 mol % of silver bromide was located at the surface of grains) was prepared. Blue-sensitizing dyes A and B, shown below, had been added in such amounts of each $2.0\times10^{-4}$ mol to large size emulsion A and each $2.5\times10^{-4}$ mol to small size emulsion A, respectively, per mol of silver. The chemical ripening of this emulsion was conducted by addind sulfur sensitizer and gold sensitizer. The above-obtained emulsified dispersion A and this emulsion A were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-triazine sodium salt was used. At that time, the amount of hardener to be added was adjusted so as to obtain a degree of swelling as shown in Table 2.

Further, in each layer, Cpd-10 and Cpd-11 were added in such amount to be total amount of 25.0 mg/m$^2$ and 50.0 mg/m$^2$, respectively.

For the silver chlorobromide emulsion in each photosensitive layer, the following spectral sensitizing dyes were used respectively:

Sensitizing dye A for blue-sensitive emulsion layer:

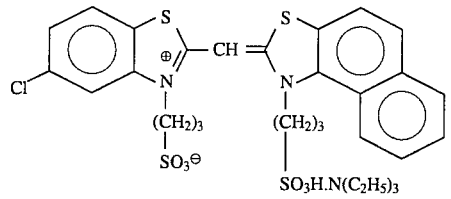

Sensitizing dye B for blue-sensitive emulsion layer:

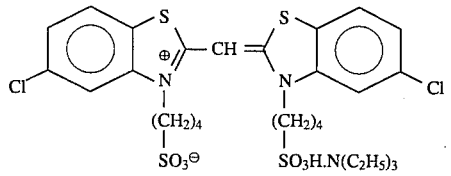

(each $2.0\times10^{-4}$ mol to large size emulsion A and $2.5\times10^{-4}$ mol to small size emulsion A, per mol of silver halide)

Sensitizing dye C for green-sensitive emulsion layer:

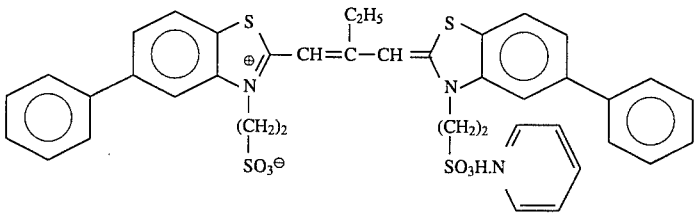

($4.0\times10^{-4}$ mol to large size emulsion B and $5.6\times10^{-4}$ mol to small size emulsion B, per mol of silver halide) and Sensitizing dye D for green-sensitive emulsion layer:

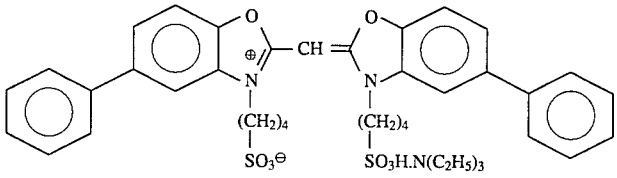

($7.0\times10^{-5}$ mol to large size emulsion B and $1.0\times10^{-5}$ mol to small size emulsion B, per mol of silver halide) Sensitizing dye E for red-sensitive emulsion layer:

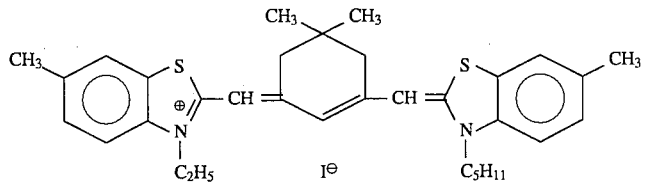

($0.9\times10^{-4}$ mol to large size emulsion C and $1.1\times10^{-4}$ mol to small size emulsion C, per mol of silver halide)

To the red-sensitive emulsion layer, the following compound was added in an amount of $2.6\times10^{-3}$ mol per mol of silver halide:

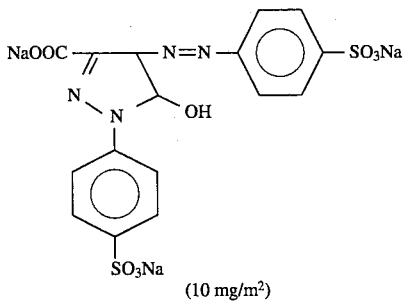

(10 mg/m²)

Further, 4-hydroxyl-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below were added to the emulsion layers for prevention of irradiation (in parentheses, coating amount is shown).

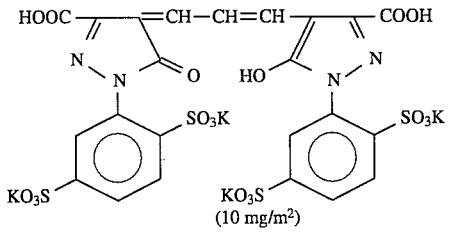

(10 mg/m²)

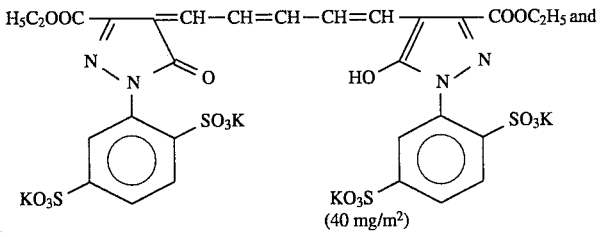

(40 mg/m²)

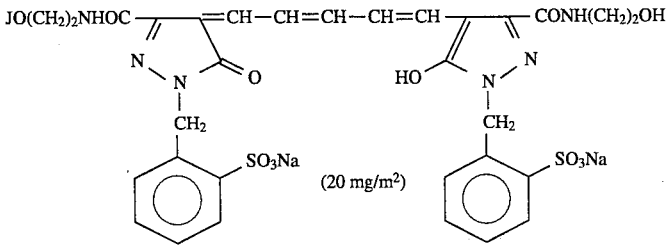

(20 mg/m²)

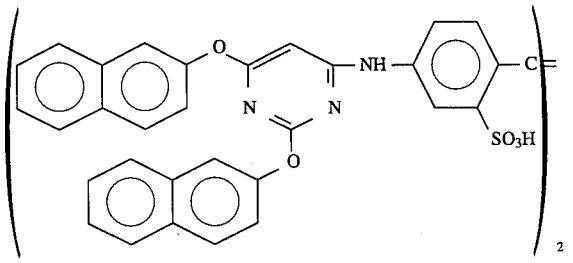

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

(Composition of Layers)

The composition of each layer is shown below. The figures represent coating amount (g/m²). The coating amount of each silver halide emulsion is given in terms of silver.

Supporting Base

Paper laminated with polyethylene (a white pigment, $TiO_2$, and a bluish dye, ultra-marine, were included in the first layer side of the polyethylene-laminated film)

First Layer (Blue-sensitive emulsion layer):

| | |
|---|---|
| First Layer (Blue-sensitive emulsion layer): | |
| The above-described silver chlorobromide emulsion A | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second Layer (Color-mix preventing layer): | |
| Gelatin | 0.99 |
| Color-mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsion (mixture (1:3 in silver molar ratio) of large size emulsion B comprising cubic grains having 0.55 μm of average grain size and small size emulsion B comprising cubic grains having 0.39 μm of average grain size, respective deviation coefficient of grain size distribution being 0.10 and 0.08, and each in which 0.8 mol % of silver bromide was located at the surface of grains) | 0.12 |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet ray absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsion (mixture (1:4 in silver molar ratio) of large size emulsion C comprising cubic grains having 0.58 μm of average grain size and small size emulsion C comprising cubic grains having 0.45 μm of acerage grain size, respective deviation coefficient of grain size distribution being 0.09 and 0.11, and each in which 0.6 mol % of silver bromide was located at the surface of grains) | 0.23 |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:
(ExY) Yellow coupler

-continued
Mixture (1:1 in molar ratio) of
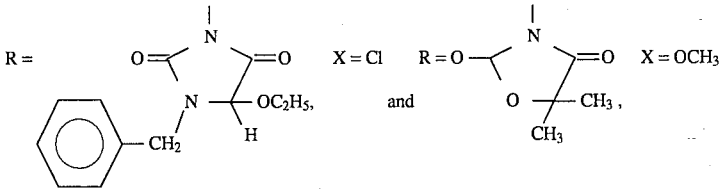
of the following formula
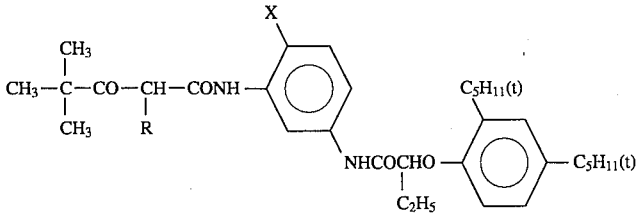
(ExM) Magenta coupler
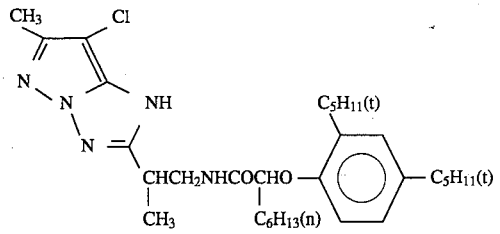
(ExC) Cyan coupler
Mixture (1:1 in molar ratio) of
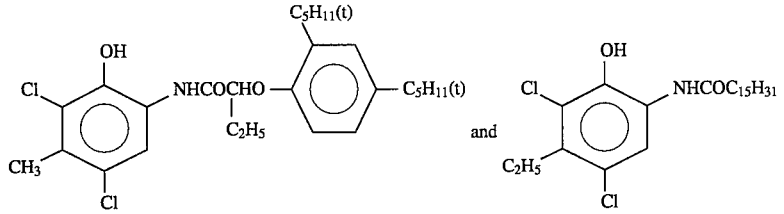
(Cpd-1) Image-dye stabilizer
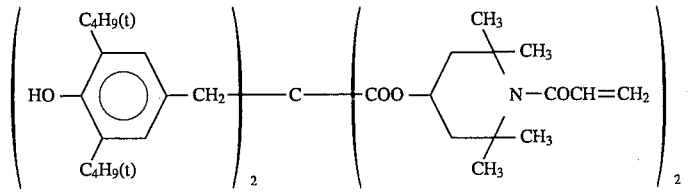
(Cpd-2) Image-dye stabilizer
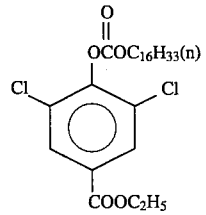
(Cpd-3) Image-dye stabilizer -continued
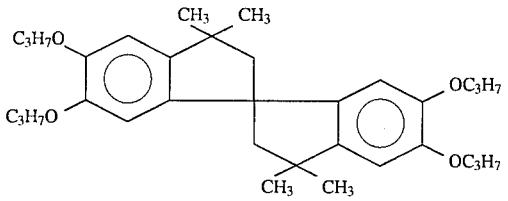
(Cpd-4) Image-dye stabilizer
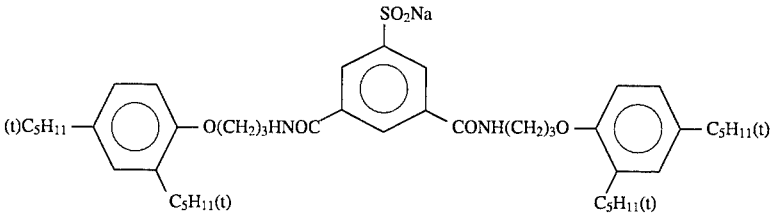
(Cpd-5) Color-mix inhibitor
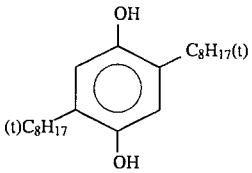
(Cpd-6) Image-dye stabilizer
Mixture (2:4:4 in weight ratio) of
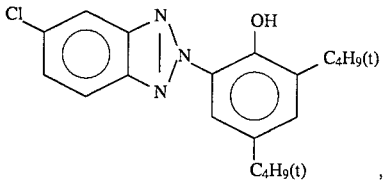
,
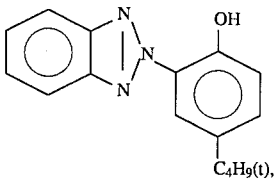
and
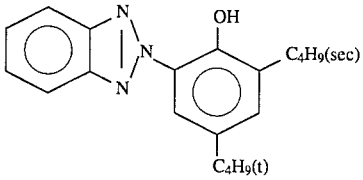
(Cpd-7) Image-dye stabilizer
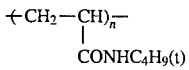
Average molecular weight: 60,000
(Cpd-8) Image-dye stabilizer
Mixture (1:1 in weight ratio) of
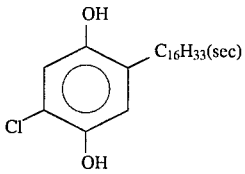
and
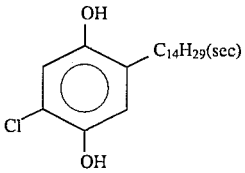
(Cpd-9) Image-dye stabilizer -continued
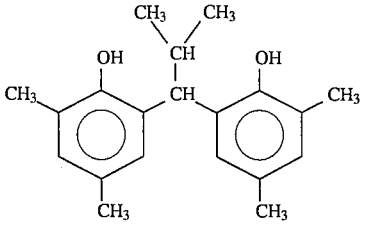
(Cpd-10) Antiseptic
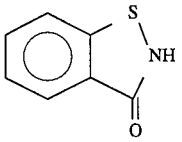
(Cpd-11) Antiseptic
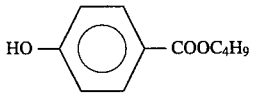
(UV-1) Ultraviolet ray absorber
Mixture (4:2:4 in weight ratio) of
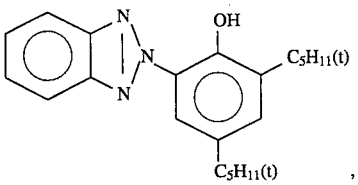
,
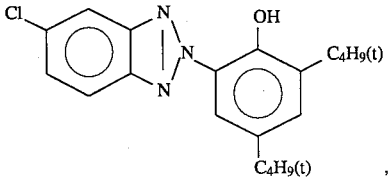
,
and
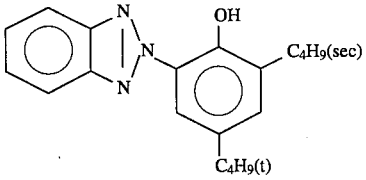
(Solv-1) Solvent
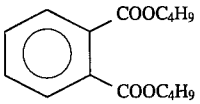
(Solv-2) Solvent
Mixture (1:1 in volume ratio) of
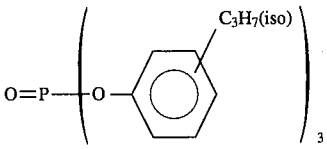
and
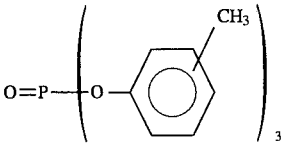
(Solv-3) Solvent
$O{=}P{+}O{-}C_9H_{19}(iso))_3$
(Solv-4) Solvent -continued

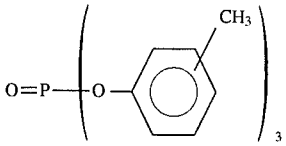

(Solv-5) Solvent

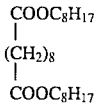

(Solv-6) Solvent

Mixture (80:20 in volume ratio) of

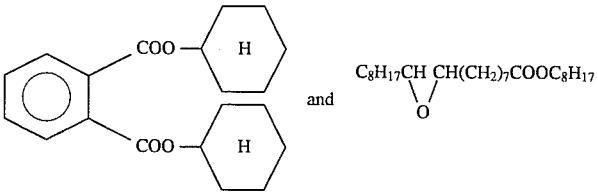

(Solv-7) Solvent

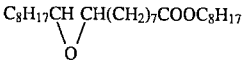

Each of samples thus-obtained was subjected to an image-wise exposure to light and then to continuous processing through the following steps shown below, until the volume of color developer twice that of a tank had been replenished.

| Processing step | Temperature | Time | Replenisher Amount* | Tank Volume |
|---|---|---|---|---|
| Color developing | 39° C. | 45 sec | 80 ml | 10 liter |
| Bleach-fixing | 35° C. | 45 sec | 60 ml** | 10 liter |
| Rinse (1) | 35° C. | 20 sec | — | 5 liter |
| Rinse (2) | 35° C. | 20 sec | — | 5 liter |
| Rinse (3) | 35° C. | 20 sec | 360 ml | 5 liter |
| Drying | 80° C. | 60 sec. | | |

Note:
*Replenisher amount is shown in ml per $m^2$ of photographic material.
**In addition to 60 ml shown above, 120 ml/$m^2$ of photographic material was let flow from the tank of rinse (1).
Rinse steps were carried out in 3-tanks counter-flow mode from the tank of rinse (3) towards the tank of rinse (1).

The compositions of each processing solution were as follows:

| | Tank Solution | Replenisher |
|---|---|---|
| Color developer | | |
| Water | 700 ml | 700 ml |
| Additive (see Table 2) | 0.1 g | 0.1 g |
| Ethylenediamine-tetraacetic acid | 0.4 g | 0.4 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |

-continued

| | Tank Solution | Replenisher |
|---|---|---|
| Fluorescent whitening agent (WHITEX 4B, made by Sumitomo Chemical Ind. Co.) | 1.0 g | 3.0 g |
| Sodium sulfite | 0.1 g | 0.1 g |
| Compound No. 17 of formlla (III) | 10.0 g | 13.0 g |
| N-ethyl-N-(β-methanesulfonamidoethyl)-3-methyl-4-aminoaniline sulfate | 5.0 g | 11.5 g |
| Water to make | 1000 ml | 1000 ml |
| pH (25° C.) | 10.10 | 11.10 |
| Bleach-fixing solution | | |
| Water | 600 ml | 150 ml |
| Ammonium thiosulfate (700 g/l) | 100 ml | 250 ml |
| Ammonium sulfite | 40 g | 100 g |
| Iron (III) ammonium ethylenediamine-tetraacetate | 55 g | 135 g |
| Ethylenediaminetetraacetic acid | 5 g | 12.5 g |
| Ammonium bromide | 40 g | 75 g |
| Nitric acid (67%) | 30 g | 65 g |
| Water to make | 1000 ml | 1000 ml |
| pH (25° C.) (adjusted by acetic acid and aqueous ammonia) | 5.8 | 5.6 |

Rinse solution (Both tank solution and replenisher) Deionized water (each amount of calcium ions and magnesium ions being 3 ppm or below)

After the color photographic materials wherein the amounts of hardeners were adjusted were continuously processed under conditions shown in Table 2, similarly to Example 1, the color photographic materials were subjected to an wedge exposure to light and the increment (ΔDmin) of the minimum density (Dmin) of the yellow between before and after the continuous processing was determined. Further, the extent of sticking at the maximum density part (Dmax) of the color photographic materials after the continuous processing was evaluated similarly to Example 1. The results are shown in Table 3.

TABLE 3

| No. | Degree of swelling | Additive in color developer | Yellow Δ Dmin | Sticking preventing property | Remarks |
|---|---|---|---|---|---|
| 1 | 1.1 | — | 0.09 | x | Comparative example |
| 2 | " | I-4 | 0.08 | Δ | Comparative example |
| 3 | 2.0 | — | 0.08 | x | Comparative example |
| 4 | " | I-4 | 0.01 | ○ | This invention |
| 5 | " | I-14 | 0.01 | ○ | This invention |
| 6 | 3.2 | — | 0.07 | xx | Comparative example |
| 7 | " | I-4 | 0.04 | xx | Comparative invention |
| 8 | 2.0 | a* | 0.06 | x | Comparative invention |

Note: *a is the same compound as in Example 1.

As will be seen from Table 3, when the degree of swelling of the color photographic material is small, particularly the ΔDmin of yellow color is high even if the additive of the present invention is used (Nos. 1 and 2).

On the other hand, when the degree of swelling is large, the sticking preventing property is conspicuously worse although the ΔDmin of yellow color is rather small (Nos. 6 and 7).

In contrast, it can be understood that according to the constitution of the present invention, the ΔDmin of yellow and the sticking preventing property are desirable (Nos. 4 and 5).

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing a silver halide color photographic material, which comprises processing a silver halide color photographic material having a plurality of photographic layers, the degree of swelling of which is 1.2 to 3.0, by a color developer containing at least one compound represented by the following Formula (I) in an amount of 0.01 to 10 g/l of said color developer, the color developer being replenished with a replenisher in an amount of 25 to 150 ml per $m^2$ of the photographic material:

Formula (I)

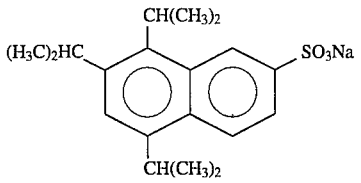

wherein, after the above color development processing, desilvering is effected with a bleach-fixing solution that contains a concentration of carbonate ions of $2.0\times10^{-1}$ mol/l to $3.0\times10^{-2}$ mol/l.

2. The method for processing a silver halide color photographic material as claimed in claim 1, wherein said color developer is substantially free from benzyl alcohol.

3. The method for processing silver halide color photographic material as claimed in claim 1, wherein the compound represented by formula (I) is added in an amount of 0.05 to 5 g per liter of the color developer.

4. The method for processing silver halide color photographic material as claimed in claim 1, wherein the degree of swelling of the photographic layers is 1.3 to 2.7.

5. The method for processing silver halide color photographic material as claimed in claim 1, wherein the silver halide emulsion in said silver halide color photographic material comprises a silver chlorobromide or silver chloride having a silver chloride content of 90 mol % or more.

6. The method for processing silver halide color photographic material as claimed in claim 1, wherein the bleach-fixing solution contains carbonate ions that have been carried over from the color developer.

7. The method according to claim 1, wherein the color developer contains an alkali metal ion as a counter cation for the carbonate ions.

* * * * *